US006581806B2

(12) United States Patent
Lilienthal

(10) Patent No.: US 6,581,806 B2
(45) Date of Patent: Jun. 24, 2003

(54) DISPENSER PACKING FOR VISCOUS OR PASTY MATERIAL

(75) Inventor: Hans Peter Lilienthal, Hamburg (DE)

(73) Assignee: Aerosol-Technik Lindal GmbH, Bad Oldesloe (DE)

( * ) Notice: Subject to any disclaimer, the term of this patent is extended or adjusted under 35 U.S.C. 154(b) by 98 days.

(21) Appl. No.: 09/815,138

(22) Filed: Mar. 22, 2001

(65) Prior Publication Data

US 2001/0027982 A1 Oct. 11, 2001

(30) Foreign Application Priority Data

Mar. 23, 2000 (DE) ..... 200 05 484

(51) Int. Cl.[7] ..... B67D 5/42
(52) U.S. Cl. ..... 222/389; 141/20
(58) Field of Search ..... 222/386.5, 389, 222/402.22, 263, 258, 387; 141/20

(56) References Cited

U.S. PATENT DOCUMENTS 3,756,476 A * 9/1973 Bonduris ..... 222/386.5
5,405,054 A * 4/1995 Thomas ..... 222/389
5,551,601 A * 9/1996 Camm et al. ..... 222/389
5,785,301 A * 7/1998 Scheindel ..... 222/402.22
5,992,706 A * 11/1999 Patterson et al. ..... 222/386.5
6,131,776 A * 10/2000 De Laforcade et al. ..... 222/389

FOREIGN PATENT DOCUMENTS

| | | |
|---|---|---|
| DE | 32 10 777 | 11/1982 |
| DE | 38 11 468 | 10/1989 |
| DE | 41 32 422 | 3/1997 |

* cited by examiner

*Primary Examiner*—Philippe Derakshani
(74) *Attorney, Agent, or Firm*—Vidas, Arrett & Steinkraus P.A.

(57) ABSTRACT

A dispenser packing for viscous or pasty material, comprising a cylindrical container; a piston slidingly movable in said container which divides the interior of the container into an upper chamber for receiving the material and a lower chamber; an expulsion valve for the material at the upper end of the container; a charging valve at the lower end of the container; a hose-shaped or pouch-shaped expulsion element which is connected to the portion of the charging valve which is inside the container and is adapted to be filled with a propellant gas under a pressure, and which abuts, on an outer wall portion, against the piston under a pressure.

12 Claims, 1 Drawing Sheet

1 / 1

DISPENSER PACKING FOR VISCOUS OR PASTY MATERIAL

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to a dispenser packing.

Dispenser packings are known to a large extent in varied configurations and for most different materials. Thus, most different flowable media are packaged in the cosmetics section, as cleansing agents, foodstuffs, in the construction industry and the like and are dispensed by means of suitable dispensing and proportioning devices. Particularly widespread are aerosol cans in which a propellant gas is admixed to a liquid medium under a pressure. The ejection of the medium is effected through an appropriate dispensing valve and a so-called spray head, in case of need. It is also known to accommodate the medium to be ejected in a pouch which is connected to the expulsion valve and is housed in a container which, in turn, is filled with a propellant medium. The propellant medium exerts a pressure onto all sides of the pouch and, thus, presses the medium out of the pouch if the expulsion valve is actuated. A packing of this type is used if the gaseous propellant needs to be prevented from contacting the medium to be ejected. In addition, this manner allows to eject pasty media by means of a gaseous propellant. It is also known to invert the assembly in the packing described last by filling the propellant into a pouch and filling the medium to be ejected in a container chamber which surrounds the pouch.

It is the object of the invention to provide a dispenser packing for a viscous or pasty material wherein a contact is also prevented between a gaseous propellant and the material to be ejected.

BRIEF SUMMARY OF THE INVENTION

In the inventive packing, a piston which is slidingly movable in a cylindrical container divides the container into an upper chamber and a lower chamber. The upper chamber serves for receiving the material to be ejected and the lower chamber receives a hose-shaped or pouch-shaped expulsion element which bears on the piston and is filled with a propellant gas. Filling is effected via a charging valve disposed at the lower end of the container to the chest of which the expulsion element is connected. The upper end of the container has provided thereon a conventional expulsion valve which can be designed as a tilting valve in an aspect of the invention.

The expulsion valve may have been mounted already before the container is filled with the material to be dispensed. Therefore, it is unnecessary to feed the material under a pressure, if necessary, to the container through the charging valve. After filling it with the material to be dispensed, the piston is inserted and the expulsion element is mounted along with the charging valve. The latter is sealingly connected to the container in an efficient way which is known as such. Now, propellant gas is led into the expulsion element under a pressure through the charging valve up to a predetermined pressure with the feed volume and the pressure being sufficient to efficiently propel the piston up to the upper end of the container. It should be understood that the charging valve is disposed so as not to protrude beyond the lower end of the container and, hence, the container may be placed upright on a support. Besides, a cap, e.g. in plastic, can be slipped onto the lower end of the container to protect the charging valve and prevent any unintended actuation. This further will give the container a more sightly appearance. The expulsion element may be formed from a plastic sheeting which can be coated, in case of need, is spirally rolled, folded or is disposed in the shape of a concertina bellows in the lower chamber and is connected to the chest of the charging valve in an appropriate manner, e.g. by welding.

The container may be formed from sheet metal material or plastic. If sheet metal material is used a co-called valve plate, which is connected to the edge of the container by forming it thereto under a pressure, mostly is provided for both the expulsion valve and charging valve. However, if a plastic container is provided instead the charging valve, for example, may be joined or welded to the container edge in an appropriate manner. For the expulsion valve, a provision can also be made for the chest of the charging valve to be pressed into an aperture of the container. Particular molding operations will then be unnecessary. The valve chest may be made of an elastic material to enable it to be pressed into the container aperture. Subsequently, a dispensing stem with a valve member may be pressed into a passage of the chest.

The invention primarily serves for receiving viscous or pasty material such as sealing materials, which must not come into contact with air before being ejected because otherwise they will cure and/or react chemically. They further include foamed polyurethane or polyurethane adhesives for the construction sector, but also cosmetics, foodstuffs or the like.

BRIEF DESCRIPTION OF THE SEVERAL VIEWS OF THE DRAWINGS

The invention will now be explained in greater detail with reference to an embodiment illustrated in the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
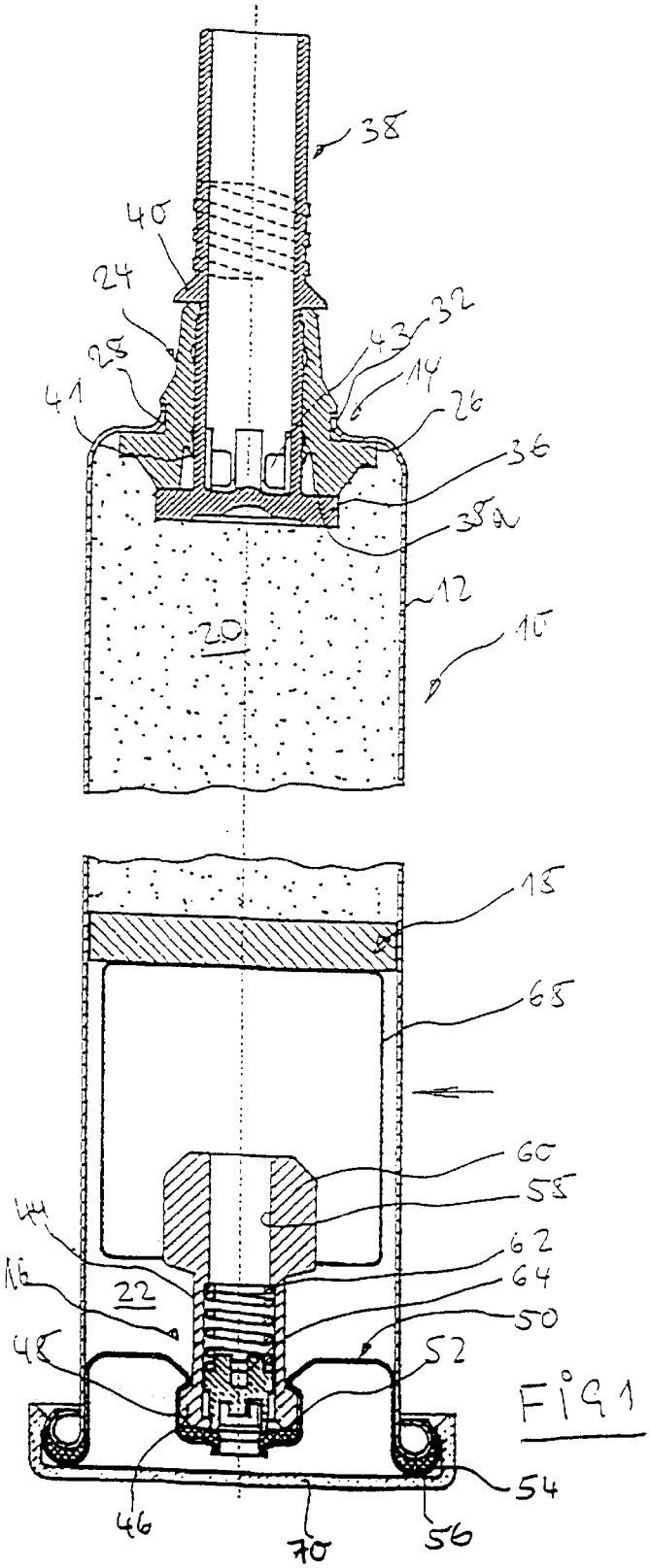
FIG. 1 shows a section through a packing according to the invention.

Referring to FIG. 1, a cylindrical container 10 is shown the shell 12 of which is made of plastic or sheet metal. An expulsion valve 14 is provided at the upper end of the container 10 and a charging valve 16 is provided at the lower end thereof. A piston 18 formed as a plastic disk is disposed within the container shell 12. It is movable in the container slidingly and sealingly and divides the interior of the container into an upper chamber 20 to receive a material to be ejected and a lower chamber 22. As the container 10 is relatively long a middle portion is not shown for drawing-related reasons. The expulsion valve 14 has a chest 24 made of moldable plastic material. It is formed like a sleeve with a lower radial flange 26 and an annular groove 28 above the flange 26. The edge of an upper aperture of the container 10 is seated in the groove 26. The aperture has an upwardly bent edge 32 the cross-section of which is formed like a circular arc. The valve chest 24 is pressed into the aperture of the container 10 with the edge 32 snapping into the groove 28. This retains the chest 24 on the container 10. A plate-shaped valve member 36 sealingly engages a lower valve seat 38*a* of the chest 24. Integrally connected to the valve member 36 is a hollow stem 38 which has a radial flange 40 which interacts with the upper sleeve-shaped end of the chest 24. In the position shown, the chest 24 exerts a certain tension between the flange 40 and the valve member 36. Thus, sufficient sealing is effected on the valve seat 38*a* and is intensified by the pressure prevailing in the chamber 20.

The stem 38, which is pressed into an axial passage of the chest 24, is sealingly seated in the axial passage as is suggested, for example, by a sealing lip at 41. Below the lip, several radial apertures 43 are formed in the stem 38 for the entry of material into the interior of the hollow stem 38.

For an actuation, it is necessary to tilt the stem 38 more or less sidewards, which causes the valve member 36 to lift from the valve seat 38*a* on one side and to clear a passage to the interior of the stem 38. Such an expulsion valve is known, on a principle. The charging valve 16 has a chest 44 made of plastic material which connects its upper end 46 to a dome 48 of a valve plate 50 by forming it thereto under a pressure. The end 46 engages a sealing 52 between the upper end of the dome and the valve chest 44. The valve plate 50 has an edge 54 the cross-sectional shape of which is like a circular arc and receives a sealing 56 for the purpose of a sealing connection with a rolled-up lower edge of the container shell 12.

The valve chest 44 provided with an axial passage 58 has a inner widened portion 60. The middle portion of the passage 58 has disposed therein a compression spring 62 which bears against the lower end of a piston-shaped valve member 64 which interacts with the sealing 52. If the valve member 64 is pressed inwardly a radial gap is cleared for a gaseous medium to pass through.

Figure 2:
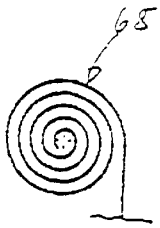
FIG. 2 shows a side view of the expulsion element of the packing.

The portion 60 of the valve chest 44 has connected thereto a hose-like, spirally rolled pouch 68, e.g. by welding (also see FIG. 2). The charging valve 16 can help in filling the pouch 68 with a gaseous medium under a pressure. It makes an attempt to expand, thus acting on the piston 18, which acts on the material to be ejected in the chamber 20. The pouch 68 is appropriately formed so that it receives a certain volume of a gaseous propellant at a relatively high pressure, which enables the pouch to expand into the chamber 20 if the piston 18 is displaced until the piston 18 comes to bear on the valve member 36. Even if the piston 18 performs its last motion the pouch 68 still is intended to generate sufficient expulsion pressure on the piston 18.

The charging valve 16 also is known as such in its basic structure. It is disposed on the container 10 in a sunk position so that the container 10 may be placed upright on a support. A cap 70 is clipped onto the edge 54 of the plate 50 and, thus, hides the charging valve 16. In addition, it makes it possible to safely position the packing 10 on a support.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto

What is claimed is:

1. A dispenser packing for viscous or pasty material, comprising:

a cylindrical container having an upper end and a lower end, the lower end being formed by a lid, a piston slidingly movable in the container which divides the interior of the container into an upper chamber for receiving the material and a lower chamber, an expulsion valve for the material at the upper end of the container, a charging valve mounted to the lid at the lower end of the container, the charging valve having a charging valve chest, a valve body, and a valve element within the valve body, a hose-shaped or pouch-shaped expulsion element connected to the valve body of the charging valve and located inside the container and adapted to be filled with a propellant gas under pressure through the charging valve and which abuts, on an outer wall portion, against the piston under pressure.

2. The dispenser packing according to claim 1, characterized in that the piston is connected to the expulsion element.

3. The dispenser packing according to claim 2, characterized in that the expulsion element is connected to a portion of the charging valve chest.

4. The dispenser packing according to claim 3, characterized in that the expulsion element is formed from a plastic sheeting.

5. The dispenser packing according to claim 4, characterized in that the expulsion element is accommodated in the lower chamber in a folded or spirally rolled condition.

6. The dispenser packing according to claim 5, characterized in that the expulsion element is folded in a concertina-like shape.

7. The dispenser packing according to claim 6, characterized in that the expulsion valve is a tilting valve and the plate-shaped valve member has a hollow dispensing stem which is sealingly disposed in the chest and at least one radial bore for the entry of the material into said stem, wherein the valve member interacts with a seating surface of the valve chest which is disposed in the upper chamber.

8. The dispenser packing according to claim 7, characterized in that the valve chest is formed from a moldable plastic and is pressed into an upper aperture of the container wherein the stem of the valve, in turn, is pressed into a bore of the chest.

9. The dispenser packing according to claim 8, characterized in that the wall of the bore has an annular sealing lip which interacts with the outside of the stem.

10. The dispenser packing according to claim 9, characterized in that the container is formed from sheet metal or plastic.

11. The dispenser packing according to claim 10, characterized in that the material is selected from the group comprising: a sealing material, a foamed polyurethane, a polyurethane adhesive, a foodstuff, a cosmetic, or any combination thereof.

12. The dispenser packing according to claim 11, characterized in that a cap is slipped or clipped onto the lower end of the chest.

* * * * *